United States Patent [19]

Matarese et al.

[11] Patent Number: 4,588,607

[45] Date of Patent: May 13, 1986

[54] METHOD OF APPLYING CONTINUOUSLY GRADED METALLIC-CERAMIC LAYER ON METALLIC SUBSTRATES

[75] Inventors: Alfred P. Matarese, North Haven; George S. Bosshart, Vernon, both of Conn.

[73] Assignee: United Technologies Corporation, Hartford, Conn.

[21] Appl. No.: 675,806

[22] Filed: Nov. 28, 1984

[51] Int. Cl.[4] ..... B05D 1/08

[52] U.S. Cl. ..... 427/34; 415/174; 427/423

[58] Field of Search ..... 427/34, 423; 415/174

[56] References Cited

U.S. PATENT DOCUMENTS

| | | | |
|---|---|---|---|
| 3,091,548 | 5/1963 | Dillon | 427/405 |
| 3,340,084 | 9/1967 | Eisenlohr | 427/423 |
| 3,413,136 | 9/1968 | Emanuelson et al. . | |
| 4,248,940 | 2/1981 | Goward et al. | 427/34 |
| 4,336,276 | 6/1982 | Bill et al. | 427/34 |
| 4,481,237 | 11/1984 | Bosshart et al. | 427/34 |

*Primary Examiner*—John H. Newsome

*Attorney, Agent, or Firm*—Charles E. Sohl

[57] ABSTRACT

Methods of coating metallic substrates with continuously graded metallic-ceramic material are disclosed. The method maintains low stress to strength ratios across the depth of the graded layer when the graded layer is under subsequent operative conditions. In one particular structure, the coating is applied to a metal substrate and includes a metallic bond coat a continuously graded metallic-ceramic layer and an outer layer of abradable ceramic material. Modulation of the metal substrate temperature during the coating process establishes a desired residual stress pattern in the graded layer.

11 Claims, 6 Drawing Figures

METHOD OF APPLYING CONTINUOUSLY GRADED METALLIC-CERAMIC LAYER ON METALLIC SUBSTRATES

CROSS REFERENCE TO RELATED APPLICATIONS

U.S. patent application Ser. No. 675,797 describes a turbine air seal using alumina as the ceramic constituent in the graded layer.

U.S. patent application Ser. No. 675,807 describes a particulate feed and control system useful in the production of sprayed turbine air seals.

U.S. patent application Ser. No. 675,801 describes a method of accurately measuring the flow of particulate material entrained in a gas stream.

These applications share a common assignee with the instant application, and are filed on even date herewith and are incorporated by reference.

TECHNICAL FIELD

This invention relates to graded metal-ceramic layers on metallic substrates and particularly to those graded layers which vary continuously from a predominately metallic to a predominately ceramic composition. The concepts were developed in the gas turbine engine industry for use of fabrication of turbine outer air seals but have a wider applicability both within this industry and others as well.

BACKGROUND ART

In modern gas turbine engines working medium gases having temperatures in excess of 2,000° F. are expanded across rows of turbine blading for extraction of power therefrom. A shroud, termed an outer air seal, circumscribes each row of turbine blading to inhibit leakage of working medium gases over the blade tips. The limitation of the leakage of the working medium gases is crucial to the achievement of high efficiencies in such engines. The graded ceramic seals described herein were developed for specific application in gas turbine outer air seals, although other applications are clearly possible. Durable seals capable of long-term, reliable service in the hostile turbine environment were required. Specifically sought were high temperature capability and good resistance to thermal shock. In addition, the seal material must have adequate surface abradability to prevent destructive interference upon occurrence of rubbing contact of the seals by the circumscribed turbine blading.

U.S. Pat. Nos. 3,091,548 to Dillion entitled "High Temperature Coatings"; 3,879,831 to Rigney et al entitled "Nickel Base High Temperature Abradable Material"; 3,911,891 to Dowell entitled "Coating for Metal Surfaces and Method for Application"; 3,918,925 to McComas entitled "Abradable Seal"; 3,975,165 to Elbert et al entitled "Graded Metal-to-Ceramic Structure for High Temperature Abradable Seal Applications and a Method of Producing Same" and 4,109,031 to Marscher entitled "Stress Relief of Metal-Ceramic Gas Turbine Seals" are representative of the known concepts applicable to ceramic faced seals.

As is discussed in some of the above references and in particular detail in U.S. Pat. No. 4,163,071 to Weatherly et al entitled "Method for Forming Hard Wear-Resistant Coatings", the temperature of the metallic substrate to which the ceramic coating is applied may be preheated to control either residual stress or coating density. Generally, such heating has been to a uniform uniform temperature. U.S. Pat. No. 4,481,237 of common assignee with the present application, describes the production of discrete layered turbine seals wherein the seal is produced by plasma spraying discrete layers of essentially fixed composition on a metallic substrate while simultaneously varying the substrate temperature.

Although many of the materials and methods described in the above patents are known to be highly desirable, the structures resulting therefrom have yet to achieve full potential, particularly in hostile environment applications. Significant research into yet improved materials and methods continues.

DISCLOSURE OF INVENTION

According to the present invention a continuously graded of metal-ceramic material having an increase in ceramic content is applied to a metal substrate under conditions of varying substrate temperature. An initial metallic bond coat is applied at an elevated temperature. The substrate temperature is then reduced and the continuously graded metal-ceramic layer is applied. During the deposition of the continuously graded layer the substrate temperature is increased generally in proportion to the ceramic content and at the outer portion of the graded coating the substrate temperature is higher than the substrate temperature during the initial bond coat.

An outer all ceramic layer is a preferred inventive feature, and the outer portion of this layer preferably contains intentional porosity to provide abradability.

A primary feature of the present invention is the control of thermal strain mismatch. Substrate temperature control during the coating process establishes a characteristic temperature at each point within the coated part at which the material at that part of the component is essentially stress free. Controlled variation of the substrate temperature during the deposition of the continuously graded layer incorporates a preferred distribution of residual stress (or prestress) throughout the layers. The residual stress distribution throughout the continuously graded layer is selected such that during operation of the part, for example in a gas turbine engine, the total stress observed at any point in the component, the total stress being the summation of the residual stress and the operationally implied stress, is significantly less than the stress required to cause failure of the part. Grading is also used when transitions are made between ceramics and where porosity is intentionally introduced.

Heating of the part in the operative environment causes relaxation of the residual compressive stresses and while further heating may induce tensile stresses in the metallic-ceramic layer the magnitude of such stresses is always well below that required to cause failure.

Another feature of the invention is the controlled variation of coating density and strength, as a function of thickness, produced by varying the gun to substrate relationship.

The foregoing and other objects, features and advantages of the present invention will become more apparent from the following description of the best mode for carrying out the invention and the accompanying drawing.

BEST MODE FOR CARRYING OUT THE INVENTION

The requirements for producing a successful graded metal-ceramic seal may be organized in two categories. The first is the residual strain which may be built into the system through control of substrate temperature during plasma deposition. The second relates to the physical requirements of the seal, particularly composition. This invention is directed at the first category, namely, the control of residual stress in the graded metal-ceramic layer. Aspects of the second category, the physical nature of the seal will be described as necessary to permit an understanding of the best mode of practicing the invention.

The invention involves the deposition of multiple thin layers of various compositions. Plasma spraying is a preferred deposition technique although alternatives such as flame spraying are known.

Figure 1:
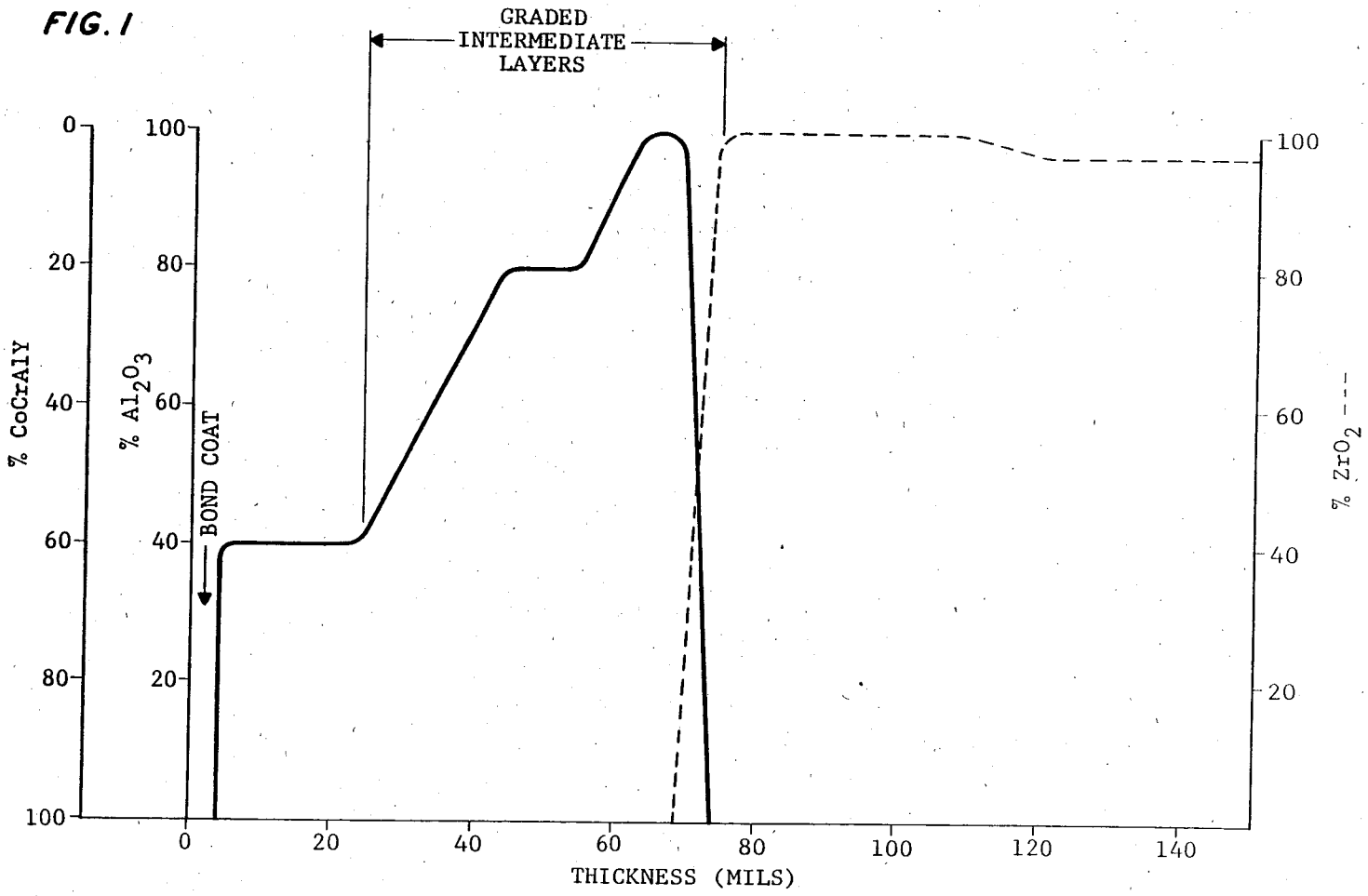
FIG. 1 shows the composition through the thickness of a seal according to the invention.

FIG. 1 illustrates the composition versus thickness of the best seal known to the inventors at the time of the filing of this application. Starting from the substrate and going outwards, the X axis shows seal thickness in mils and the total seal thickness is approximately 150 mils. Since the seal is deposited by a plasma deposition, the seal thickness will vary in a stepwise fashion from one layer to the next, however, since each layer is only about 1 mil thick the continuous curve of FIG. 1 is a more than adequate description of the seal composition.

Starting from the substrate there is an initial metallic bond coat which may be, for example, a composition known as Metco 443, a commercially available Ni-Cr-Al composition. Following the deposition of the bond coat the next 20 mils are of a constant composition of 60% CoCrAlY (nominal composition of Co-23Cr-13Al-0.65Y) having a particle size of $-100+325$ U.S. Standard Sieve and 40% alumina. Following the deposition of this constant composition layer, continuous grading occurs over the next 25 mils or so until a composition of 20% CoCrAlY and 80% alumina is reached. This composition is maintained constant for about 10 mils then the grading process continues until a composition of 100% alumina is achieved. One layer ($1\pm0.5$ mil) of 100% alumina is then deposited, it having been found that the absence of an all alumina layer detracts from oxidation performance but that multiple layers are detrimental to mechanical behavior. Finally an outer layer of zirconia is applied to provide abradability and temperature capability ($Al_2O_3$ melts at about 2000° C. while $ZrO_2$ melts at about 2700° C.). Alumina is a harder, stronger material than zirconia and alumina as the outer layer would not have the desired abradable qualities. To further increase the abradability of the zirconia deliberate porosity is induced in the zirconia in the outer portion thereof, porosity on the order of about 19%. This is accomplished by adding a fugitive material (such as Metco 600 polyester or DuPont's Lucite ®) to the ceramic material to be sprayed and subsequently after spraying removing the fugitive by baking at a high temperature to vaporize the fugitive material.

A variety of bond coats may be employed including the MCrAlY type materials (where M is iron, nickel or cobalt or mixtures of nickel and cobalt). In like manner the ceramic constituent is not limited to alumina or zirconia but may include others including mullite and $MgO.Al_2O_3$ spinel. The metallic constituent may be chosen from a broad group of oxidation resistant composition but the previously mentioned MCrJAlY materials are preferred.

Figure 2:
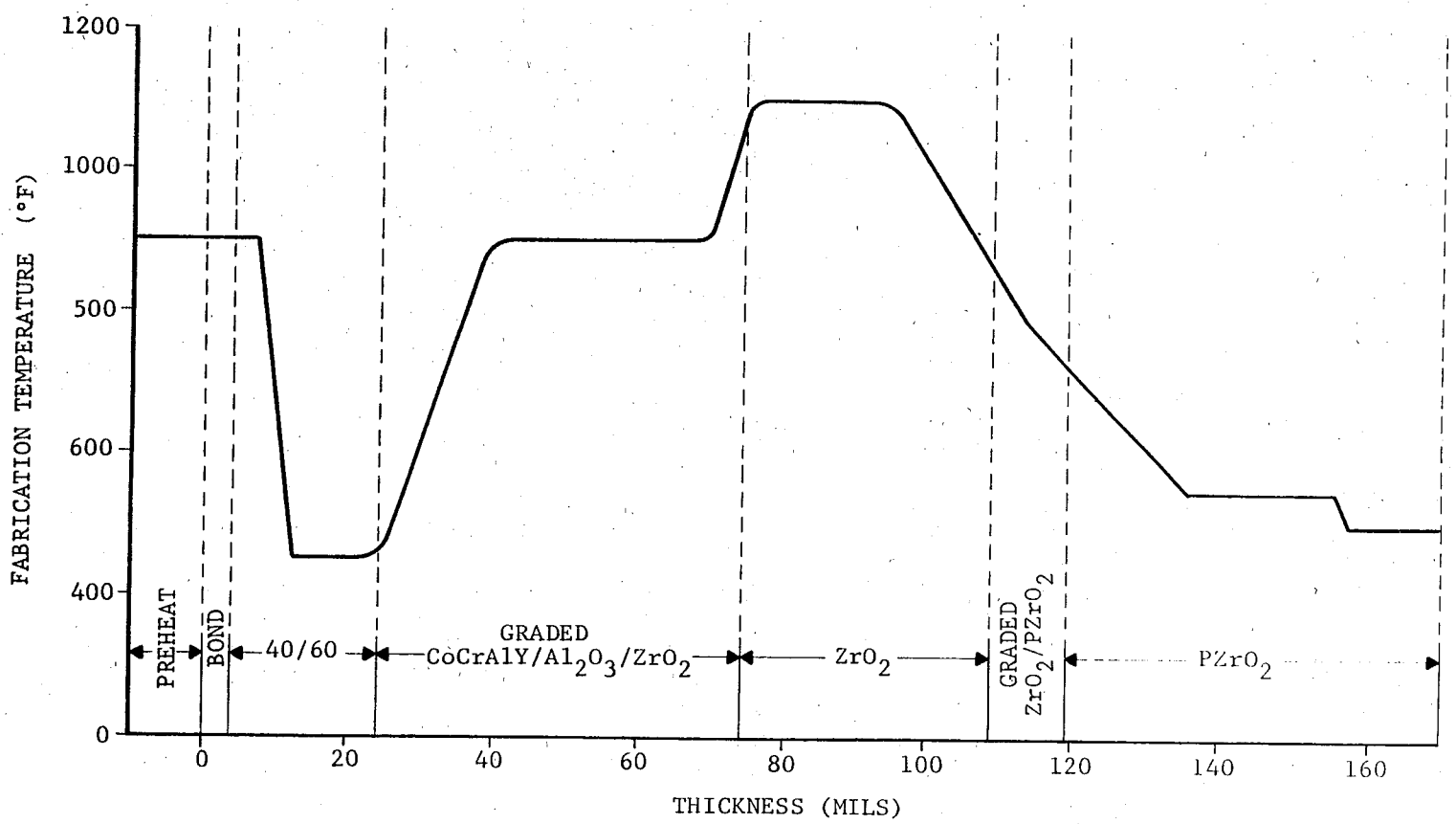
FIG. 2 shows the variation in substrate temperature during application of the seal of FIG. 1.

FIG. 2 illustrates the temperature control of the substrate which is employed during plasma spraying to attain the desired and necessary substrate prestrain conditions. This is the essence of the present invention. The substrate temperature is maintained at a relatively high level during deposition of the bond coat and is then reduced. Thereafter the substrate temperature is increased generally in approximate proportion to the ceramic content and eventually reaches a level above that employed during deposition of the bond coat and then tapers off during the deposition of the outer abradable ceramic material. One reason for reducing the substrate temperature while spraying the abradable S(ceramic+fugitive) layer is to eliminate the tendency of the fugitive to vaporize immediately upon deposition, the fugitive must be retained during spraying in order to produce porosity.

Temperature control is obtained by heating the substrate with propane burners. Temperature measurements and control is accomplished with thermocouples bonded to the backside of the substrate. Alternative heating schemes such as induction heating are possible.

The inherently differing coefficients of thermal expansion between the ceramic material and the metallic material are accommodated by the continuous grading of the coating and by inducing controlled compressive strain during the buildup of the graded layer.

Figure 3:
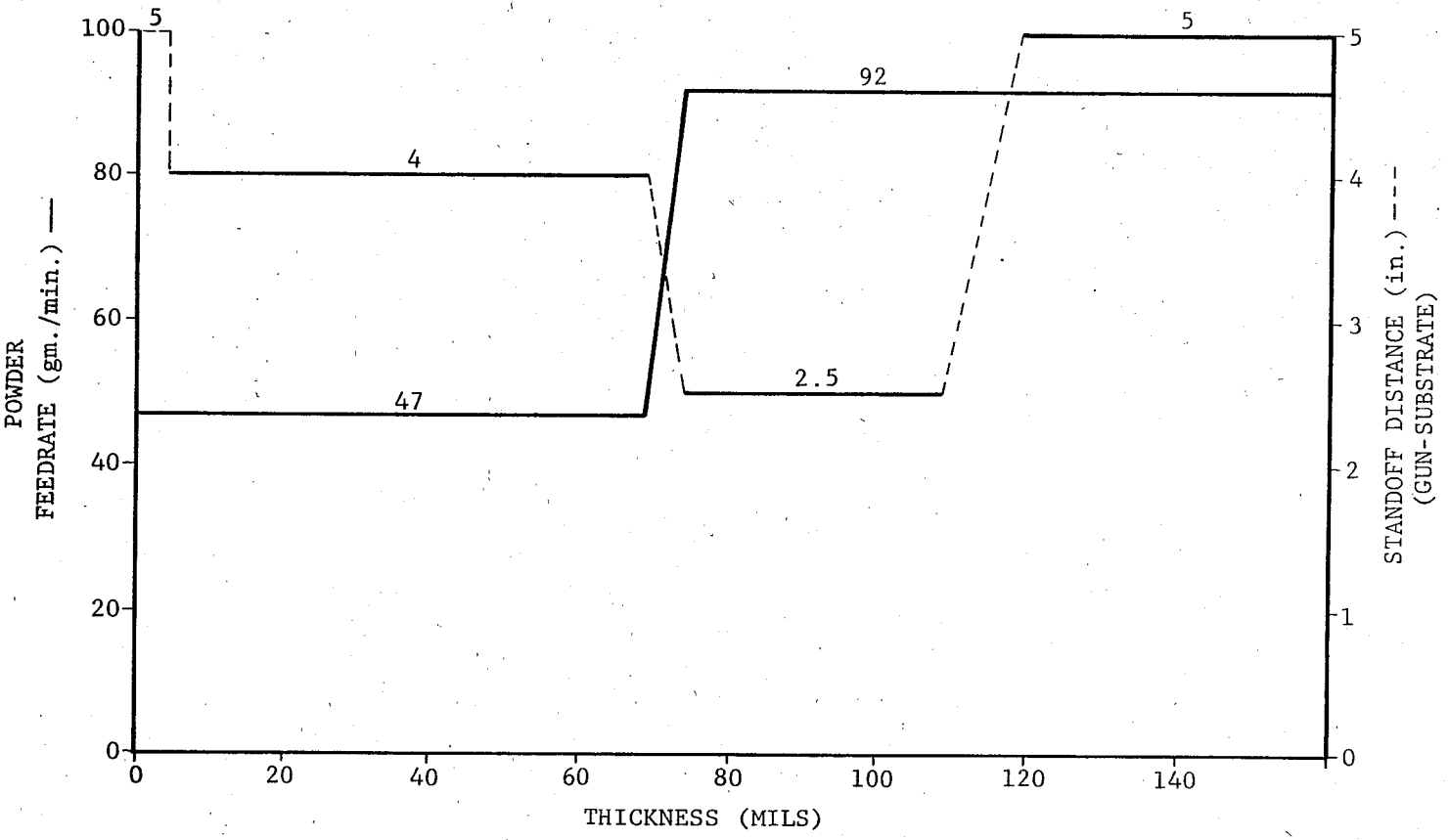
FIG. 3 shows the variation in gun to substrate distance during the application of the seal of FIG. 1.

As shown in FIG. 3 the relative gun to substrate position is varied during seal deposition in order to vary the density and strength of the seal. It is generally desirable to have higher densities and strenghts near the substrate.

Figure 4:
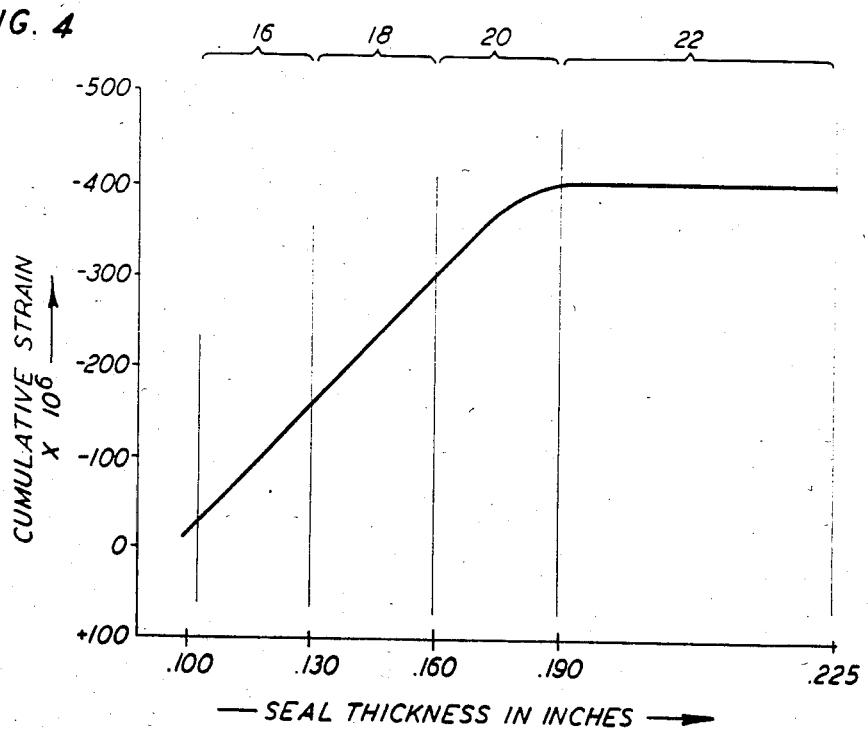
FIG. 4 shows cumulative strain through coating the thickness.

FIG. 4 illustrates accumulative strain through the coating, characteristic of parts manufactured according to the information in previously presented FIGS. 1 and 2. The graph shows increasing compressive strain measured at the back of the substrate as incremental changes in coating depth are made. The smoothly increasing shape of the curve indicates the lack of discontinuities in the part and the lack of strain reversals.

As discussed previously, the coating is designed to have a stress-free characteristics preselected temperature. The stress-free temperature is selected to be intermediate of the cold condition and the maximum temperature encountered in service.

Figure 5:
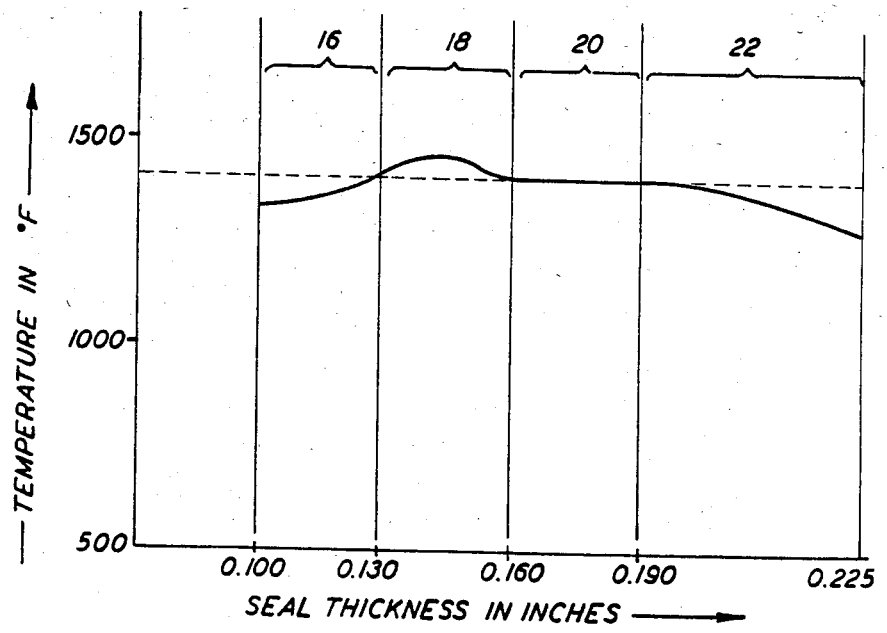
FIG. 5 shows stress-free temperature through coating thickness.

FIG. 5 illustrates the approximate stress-free temperatures through the thickness of the part and again the smooth nature of the curve is indicative of durable structure. At temperatures below the stress-free temperature the metallic substrate portion of the structure tend towards the tensile stress condition and the ceramic portion tends the compressive stress condition while at temperatures above the stress-free temperature the metallic substrate tends towards the compressive condition of the ceramic portion tends towards the tensile condition.

Figure 6:
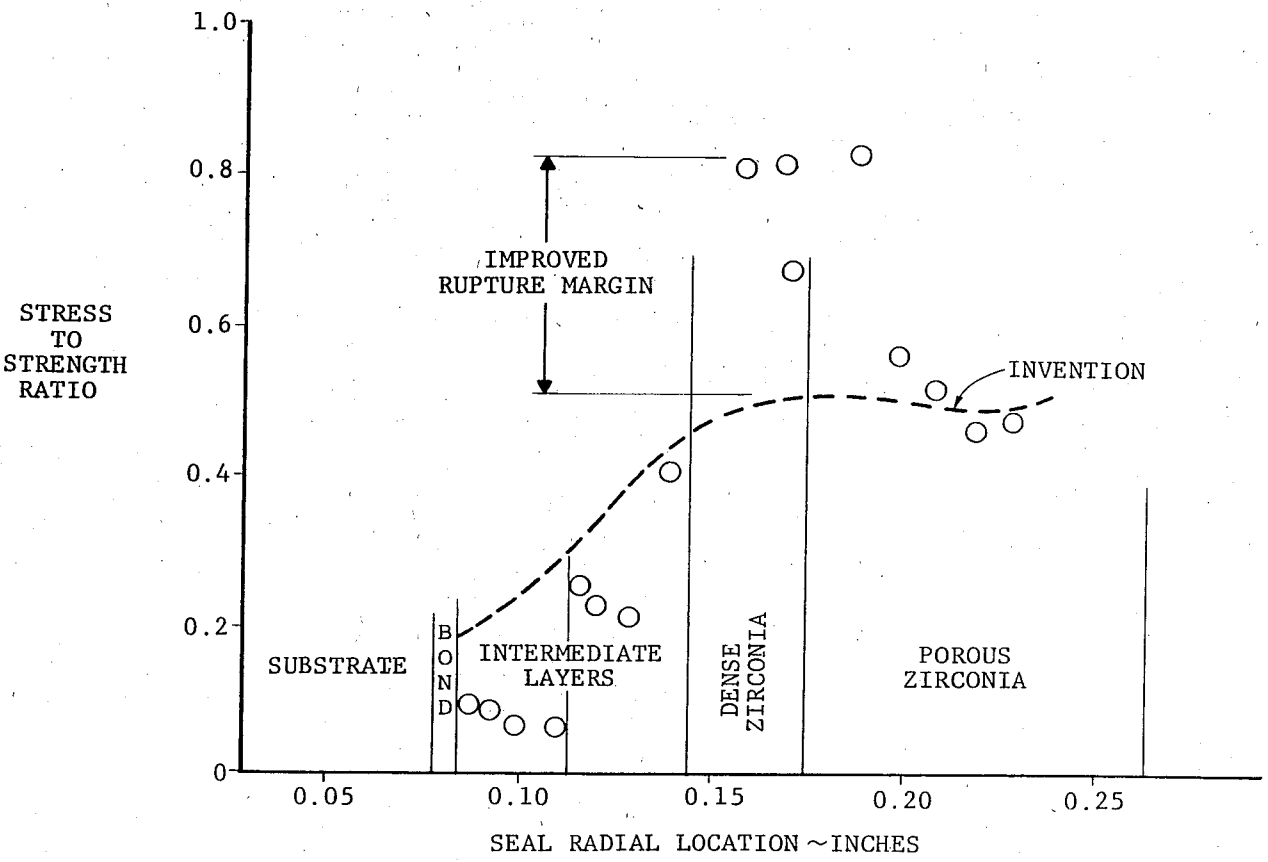
FIG. 6 shows stress-to-strength ratios of the seal according to the invention and a prior art seal.

FIG. 6 is an important figure which illustrates the benefits achieved according to the present invention. FIG. 5 illustrates the stress-to-strength ratio of the seal whose production was previously described as a function of thickness of the seal under operational conditions in a gas turbine engine, namely, under acceleration conditions encountered during takeoff. The dotted curve represents the stress-to-strength ratio characteristics of parts made according to the present invention, namely, continuously graded layers applied according to the previously described method involving continuous substrate temperature and composition control. The dots on the curve are actual data from engine hardware produced according to the method of U.S. Pat. No. 4,481,237 in which a graded layer is produced by use of discrete layers of constant composition material. It can be seen that whereas the seal made according to the prior art encountered stress-to-strength ratios on the order of 80% of that required to cause failure. The maximum stress-to-strength ratio encountered by the seal made according to the present invention is somewhat less than 60%. This gives an improved safety margin which is significant in view of the application of the component.

Although this invention has been shown and described with respect to a preferred embodiment, it will be understood by those skilled in this art that various changes in form and detail thereof may be made without departing from the spirit and scope of the claimed invention.

We claim:

1. A method for applying a graded ceramic-metallic layer to a metallic substrate including the steps of:
   a. preheating the substrate to an elevated temperature;
   b. applying a metallic bond coat;
   c. reducing the substrate temperature;
   d. applying a graded metallic-ceramic layer, by depositing a multiplicity of thin layers of material, said layers having a largely metallic composition at the bond coat interface and a composition which increases in ceramic content and decreases in metallic content through the thickness of the graded layer, increasing the substrate temperature in approximate proportion to the ceramic content with the substrate temperature exceeding that achieved in step a. when the graded layer composition is essentially all ceramic said substrate temperature increasing being uninterrupted by periods of decreasing temperature prior to termination of the process whereby the resultant prestressed graded layer is capable of resisting severe thermal conditions without failure.

2. A method as in claim 1 in which the graded layer contains one or more regions of multiple sprayed layers have identical compositions.

3. A method as in claim 1 in which the layer is applied by plasma spraying.

4. A method as in claim 3 in which control of graded layer composition is achieved by varying the relative flow rates into the plasma torch of a ceramic powder and a metallic powder.

5. A method as in claim 4 in which the powder flow rates are varied according to a predetermined schedule.

6. A method as in claim 4 in which the powder flow rates are measured and controlled during deposition.

7. A method as in claim 1 in which a layer of pure ceramic is applied on the graded layer.

8. A method as in claim 7 in which the porosity of the pure ceramic layer is controlled and in which the degree of porosity increases with distance from the graded layer.

9. A method as in claim 8 in which porosity is induced in the ceramic layer by co-spraying a ceramic powder and a fugitive material powder.

10. A method as in claim 1 in which the distance between the plasma gun and the substrate is varied during the deposition process.

11. A method for producing a gas turbine engine air seal having a metallic substrate including the steps of:
   a. preheating the substrate to an elevated temperature;
   b. applying a metallic bond coat;
   c. reducing the substrate temperature;
   d. applying a graded metallic-ceramic layer by codepositing a mixture of metal and ceramic particulate material, starting with a predominately metallic mix at the bond coat interface and finishing with a substantially ceramic composition, by measuring the mass flow rates of the respective powders during the process and adjusting the mass flow rate according to a predetermined schedule, while increasing the substrate temperature in approximate proportion to the ceramic content in the mixture being sprayed with the substrate temperatures at conclusion of the graded layer deposition substantially exceeding the substrate temperature at which the bond coat was applied said substrate temperature increasing being uninterrupted by periods of decreasing temperature prior to termination of the process;
   e. applying a layer of pure ceramic over the graded layer by plasma spraying, providing intentional porosity in the outer portion of the ceramic layer by co-spraying the ceramic material with a fugitive material, and gradually reducing the substrate temperature while depositing the pure ceramic layer; and
   f. varying the distance between the plasma gun and the substrate during the process so as to produce a more dense coating near the substrate and a less dense coating away from the substrate.

* * * * *